US012551088B2

(12) United States Patent
Almus et al.

(10) Patent No.: US 12,551,088 B2
(45) Date of Patent: Feb. 17, 2026

(54) HOUSEHOLD DISHWASHER HAVING AT LEAST ONE AIR OUTLET

(71) Applicant: BSH Hausgeräte GmbH, Munich (DE)

(72) Inventors: Alexander Almus, Bissingen (DE); Thomas Burggraf, Dillingen (DE); Christian Steck, Wiesenbach (DE)

(73) Assignee: BSH Hausgeräte GmbH, Munich (DE)

( * ) Notice: Subject to any disclaimer, the term of this patent is extended or adjusted under 35 U.S.C. 154(b) by 234 days.

(21) Appl. No.: 18/021,232

(22) PCT Filed: Sep. 30, 2021

(86) PCT No.: PCT/EP2021/076968
§ 371 (c)(1),
(2) Date: Feb. 14, 2023

(87) PCT Pub. No.: WO2022/069648
PCT Pub. Date: Apr. 7, 2022

(65) Prior Publication Data

US 2023/0301485 A1 Sep. 28, 2023

(30) Foreign Application Priority Data

Sep. 30, 2020 (DE) ..... 102020212345.4

(51) Int. Cl.
*A47L 15/48* (2006.01)
*A47L 15/42* (2006.01)

(52) U.S. Cl.
CPC ..... *A47L 15/488* (2013.01); *A47L 15/4251* (2013.01); *A47L 15/483* (2013.01); (Continued)

(58) Field of Classification Search
CPC ..... A47L 15/488; A47L 15/00–508
See application file for complete search history.

(56) References Cited

U.S. PATENT DOCUMENTS 4,179,821 A * 12/1979 Herbst ..... A47L 15/4257 34/235
5,881,746 A 3/1999 Buser
(Continued)

FOREIGN PATENT DOCUMENTS

CN 209360621 U 9/2019
DE 29601313 U1 6/1996
(Continued)

OTHER PUBLICATIONS

DE19604370A1 Machine Translation (Year: 1997).*
(Continued)

*Primary Examiner* — Spencer E. Bell
(74) *Attorney, Agent, or Firm* — Michael E. Tschupp; Andre Pallapies; Brandon G. Braun

(57) ABSTRACT

A household dishwasher includes a dishwasher cavity for processing items to be washed, a front panel attached to a front side of the household dishwasher, and an air discharge unit arranged in a lower quarter of a height of the household dishwasher and including an air outlet designed to discharge air from the dishwasher cavity and arranged in the lower quarter of the height of the household dishwasher. The air outlet extends as a slotted outlet over at least two thirds of a width of the household dishwasher. The air discharge unit is designed to be held indirectly or directly on the front panel via a retaining connection in such a way that the air discharge unit is detachable from the front panel when the front panel is dismantled.

23 Claims, 6 Drawing Sheets

(52) U.S. Cl.
CPC ..... *A47L 15/486* (2013.01); *A47L 2401/19* (2013.01); *A47L 2501/12* (2013.01)

(56) References Cited

U.S. PATENT DOCUMENTS

| | | | | |
|---|---|---|---|---|
| 8,313,583 | B2 | 11/2012 | May | |
| 9,888,829 | B1 | 2/2018 | Bongivengo | |
| 10,024,561 | B2 | 7/2018 | Olson | |
| 10,687,687 | B2 | 6/2020 | Doppelbauer | |
| 2010/0043250 | A1 | 2/2010 | Berends | |
| 2010/0083991 | A1 | 4/2010 | Tolf | |
| 2011/0126864 | A1 | 6/2011 | Kim | |
| 2011/0241503 | A1* | 10/2011 | Simon | F24C 15/30 312/111 |
| 2013/0206186 | A1 | 8/2013 | Tang | |
| 2014/0170954 | A1 | 6/2014 | Hintz | |
| 2014/0238450 | A1 | 8/2014 | Bertram | |
| 2014/0360534 | A1 | 12/2014 | Olson | |
| 2016/0022116 | A1 | 1/2016 | Delellis | |
| 2017/0290489 | A1 | 10/2017 | Noriega | |
| 2018/0125329 | A1* | 5/2018 | Parmeggiani | A47L 15/488 |
| 2019/0145630 | A1* | 5/2019 | Cross | F24C 15/2042 126/21 A |
| 2021/0100424 | A1 | 4/2021 | Tan | |

FOREIGN PATENT DOCUMENTS

| | | | | |
|---|---|---|---|---|
| DE | 19604370 | A1 * | 6/1997 | A47B 77/022 |
| DE | 19704430 | A1 | 8/1998 | |
| DE | 102019203038 | A1 | 9/2020 | |
| EP | 0378836 | A1 | 7/1990 | |
| EP | 0521815 | A1 | 1/1993 | |
| EP | 2682038 | A2 | 1/2014 | |
| EP | 3020319 | A1 | 5/2016 | |
| EP | 3114979 | A1 | 1/2017 | |
| EP | 3427628 | A1 | 1/2019 | |
| JP | 2018140243 | A | 9/2018 | |
| KR | 20130070278 | A | 6/2013 | |
| KR | 101308832 | B1 | 9/2013 | |
| KR | 101685357 | B1 | 12/2016 | |
| WO | 2013090155 | A1 | 6/2013 | |
| WO | 2015107474 | A1 | 7/2015 | |

OTHER PUBLICATIONS

International Search Report PCT/EP2021/076968 dated Jan. 13, 2022.
National Search Report CN 2021800670177 dated Apr. 7, 2025.

* cited by examiner

HOUSEHOLD DISHWASHER HAVING AT LEAST ONE AIR OUTLET

CROSS-REFERENCES TO RELATED APPLICATIONS

This application is the U.S. National Stage of International Application No. PCT/EP2021/076968, filed Sep. 30, 2021, which designated the United States and has been published as International Publication No. WO 2022/069648 A1 and which claims the priority of German Patent Application, Serial No. 10 2020 212 345.4, filed Sep. 30, 2020, pursuant to 35 U.S.C. 119(a)-(d).

The contents of International Application No. PCT/EP2021/076968 and German Patent Application, Serial No. 10 2020 212 345.4 are incorporated herein by reference in their entireties as if fully set forth herein.

BACKGROUND OF THE INVENTION

The present invention relates to a household dishwasher having at least one air outlet so as to discharge in particular moist air from a dishwasher cavity in which dishware, glasses, cutlery and similar items to be washed can be processed.

With such dishwashers, it is desirable to be able to remove the items to be washed from the dishwasher cavity as completely dried as possible and without water droplets.

For a good drying result of items to be washed, such as, for example, dishware, glasses, cutlery and similar items, which can be processed in a dishwasher cavity, it is advantageous to be able to remove moist air from the dishwasher cavity. It is therefore known to connect the dishwasher cavity to an air outlet which transports moist air from the dishwasher cavity into the outside environment. Such an air outlet is often located in the upper region of a front door that can be opened and closed. It is therefore relatively complex and expensive to supply air to this moving unit, and in addition, due to the high arrangement in the appliance, there is the risk that cabinets or worktops that are located above the household dishwasher, or even parts of the household dishwasher and its paneling, will be damaged by the high moisture flowing out, or that the kitchen floor in the region in front of the household dishwasher will become wet and therefore slippery. In addition, there is a considerable draught in the vicinity of such an air outlet, which is very uncomfortable, especially in small kitchens where users sit close to a household dishwasher.

As an alternative to an air outlet in the front door, the front door of the respective household dishwasher is frequently opened in gaps during the drying phase of a dishwashing program that is to be executed so as to assist drying, so that moist dishwasher interior air can escape from the dishwasher interior of the dishwasher cavity into the environment at the installation site of the household dishwasher and be replaced by ambient air that is drier than it. However, opening the door in this way—especially when it occurs in the initial phase of the drying phase—is associated with the removal of heat energy from the dishwasher cavity, which is counterproductive in terms of energy, since the heat is required for drying.

The invention is based on the problem of achieving the greatest possible avoidance of water vapor impact on surrounding furniture, the kitchen floor and front parts of the household dishwasher while maintaining an attractive visual arrangement and at the same time enabling an air outlet to be assembled and dismantled in a simple manner, also for maintenance purposes.

BRIEF SUMMARY OF THE INVENTION

The invention solves this problem by a household dishwasher having the features of the independent claim. With respect to advantageous embodiments and developments of the invention, reference is made to the dependent claims.

Insofar as spatial and/or local specifications are given in the context of the invention, these are preferably to be understood from a standpoint which a user assumes during intended use and/or operation in front of the household dishwasher in accordance with the invention when it is set up or installed ready for operation.

When dishwasher interior air is discharged from the dishwasher interior of the dishwasher cavity by means of the air discharge unit into the open air, i.e. into the environment at the respective installation or assembly location of the household dishwasher that is designed in accordance with the invention during at least one drying phase, the front door of the household dishwasher, which can preferably be pivoted about a lower horizontal pivot axis that is oriented in the transverse or width direction, remains closed, i.e. closed. This renders it possible to avoid moist dishwasher interior air flowing out from the opening gap between the upper region of the front door and the dishwasher cavity and leaving said dishwasher cavity in an upward direction and to avoid condensate from the outflowing moist warm dishwasher interior air depositing on items of kitchen furniture that are located above the opening gap, such as, for example, a kitchen worktop, which could lead to moisture damage there. It is also possible to avoid uncontrollable and/or excessive heat losses from the dishwasher interior of the dishwasher cavity into the environment, which would be associated with a gap-wise door opening, which would adversely affect the drying efficiency of the respective drying phase. In addition, by the front door remaining closed during the respective drying phase, dirt particles such as, for example, dust particles and/or germs and/or other foreign bodies are prevented from entering the dishwasher interior from the environment onto the items to be washed that have previously been washed clean by means of washing liquid. Finally, by the front door that is remaining closed, operating errors and/or misinformation which could be caused in the case of the user by a gap-wise open front door are largely avoided. For example, a user often mistakenly interprets a front door that is open in a gap as the end of a dishwashing program, even though the drying phase that concludes the program has not yet ended.

The household dishwasher that is designed in accordance with the invention provides in particular one or more dishwashing programs, in which in each case the items to be washed that are to be cleaned in the dishwasher interior of the dishwasher cavity of the household dishwasher are exposed to washing liquid or washing liquor in one or more liquid-carrying sub-washing phases, such as, for example, pre-washing phase, cleaning phase, intermediate washing phase, clear washing phase, and while the front door remains closed are then dried in a drying phase that concludes the washing program by means of the air discharge unit in accordance with the invention, in order subsequently after opening the front door to be able to remove said items from the dishwasher interior as completely dried as possible and without water droplets. If necessary, the end of the drying phase of the respective dishwashing program can be followed by a so-called "storage function phase" or storage phase for a predetermined period of time, until the end of which it is ensured by means of one or more additional drying phases that the items to be washed continue to remain dry in the dishwasher interior while the front door of the household dishwasher remains closed. This "storage function phase" can preferably extend over several days. In addition or independently thereof, other operating functions of the household dishwasher can also be provided by the air discharge unit in accordance with the invention. For example, an odor elimination program can be implemented in which dishwasher interior air is discharged into the environment of the household dishwasher by means of the air discharge unit and fresh air is sucked as a replacement into the dishwasher interior if there is a risk of bad odors forming in the dishwasher interior. This can happen, for example, if, after the end of the last dishwashing program and the removal of the clean and dried items to be washed, new soiled items to be washed are brought into the dishwasher interior of the dishwasher cavity and are then stored for a longer period of time in the dishwasher interior of the dishwasher cavity with the front door closed until the next dishwashing program is started.

The fact that, in accordance with the invention, an air discharge unit that comprises at least one air outlet is arranged in the lower quarter of the appliance height means that, if water vapor rises from the air outlet, at most the household dishwasher itself, in particular its front door, is acted upon, so that some of the water can condense there and does not impact upon the furniture above. In addition, the fact that the air outlet extends as a slotted outlet over at least two-thirds of the width of the household dishwasher ensures a broad distribution of the moisture flowing out and ensures it mixes with the drier outside air in the room. The moist dishwasher interior air flowing out is thus distributed, and any high moisture entry into furniture is avoided. In a favorable manner, this largely prevents any noticeable condensate from depositing at all on the front door above the slotted outlet, in particular on its lower edge and/or any furniture panel or decorative panel that is attached to the front. Drafts are also considerably reduced due to the good distribution width of the air. Assembling and dismantling are facilitated as a result of the air discharge unit that comprises the air outlet being mounted indirectly or directly on a panel or front panel that is attached to the front side of the household dishwasher, wherein the retaining connection between an air discharge unit, which comprises the air outlet, and the front panel can be released when the front panel is dismantled. The front panel can be removed without thereby an air supply line that supplies air, in particular dishwasher interior air, to the air discharge unit being subjected to unacceptably high tensile stresses, in particular without an air hose that is provided as an air supply line being overstretched, or even being able to tear off from the air discharge unit. Maintenance of the household dishwasher is also greatly facilitated as a result.

In particular, the front panel is a plinth strip or plinth board which covers at the front below the front door a lower plinth region of the household dishwasher, in particular said lower plinth region being set back relative to the front of the household dishwasher, and the dishwasher cavity is arranged above said lower plinth region. If the household dishwasher is installed as a built-in appliance close to the floor in a built-in niche below a kitchen worktop, the plinth strip or plinth board is preferably located on the floor. In this case in particular, the front panel, preferably the plinth board, can be set back in the depth direction of the household dishwasher relative to the front lower edge of the front door, which can be fitted with a front furniture panel or decorative panel. If the household dishwasher is installed in a built-in niche below the worktop of a built-in kitchen, the front panel can be formed in particular by the kitchen plinth strip of the built-in kitchen, which preferably stands up on the floor. If the household dishwasher is designed as a freestanding appliance, an appliance which is built in below a worktop, or as a compact appliance such as, for example, a tabletop appliance, or as a built-in appliance that is built into a piece of kitchen furniture such as, for example, a kitchen wall unit, the plinth panel can be attached to its appliance plinth, which is setback relative to the plinth panel, preferably at the factory, in such a way that the plinth panel is essentially flush with the outer surface of the front door when the latter is brought into its approximately vertical closing end position.

If the retaining connection between the air discharge unit, which comprises the air outlet, and the front panel can be released without the use of tools when the front panel is dismantled, the front panel, in particular the plinth panel, can be dismantled particularly quickly and easily.

In particular, the retaining connection between the air discharge unit, which comprises the air outlet, and the front panel can also be released, preferably by dismantling the front panel alone, in order thus to be able to remove the front panel in just one step.

In addition or alternatively, the retaining connection between the air discharge unit, which comprises the air outlet, and the front panel can be moved into an engagement position without the use of tools by assembling the front panel in order also to facilitate (re)assembling the front panel.

Preferably, the air outlet of the air discharge unit has an air discharge duct that extends toward the front side when viewed in its final assembly position.

The air discharge duct is expediently designed in such a way that, in the final assembly position of the air discharge unit, it engages over the front panel which closes off the plinth of the household dishwasher at the front, and in particular projects at least the same distance toward the front side with respect thereto. If, advantageously, the air outlet of the air discharge unit with its air discharge duct engages over a front panel, in particular a plinth panel, which closes a plinth at the front and projects at least the same distance toward the front side with respect thereto, air can be discharged to the front without moisture impacting a decorative panel or kitchen furniture panel, which is attached to the front of the front door, and/or on or in adjacent furniture, this is particularly the case if the household dishwasher is installed, for example, on the floor in a built-in kitchen niche below a kitchen worktop or in a built-in niche of a piece of kitchen furniture—preferably as a compact appliance—installed in a kitchen cabinet. In addition, the air outlet facility of the air outlet can be accommodated in this way in a visually inconspicuous manner with good design. Thus, the discharged air is guided away from the front of the household dishwasher in accordance with the invention, in particular from its front door that is fitted with a decorative panel or kitchen furniture panel, and/or the adjacent kitchen furniture; the accumulation of moisture in the installation space of kitchen furniture is then avoided. In this way, the air which is flowing out there at the front end of the, in particular slot-shaped, air discharge duct of the air outlet, and which is often laden with moisture can mix quickly and over a large area with the outside air in the kitchen, said outside air being drier than said air which is flowing out.

Preferably, the air discharge unit comprises an air pre-distributor which, in its final assembly position, projects upward and extends in the width direction, the upper end of which is adjoined by the air discharge duct of the, in particular slot-shaped, air outlet, said air discharge unit extending toward the front side, and which has an, in particular rear, connection for an air supply line. In the final assembly position of the air discharge unit, the air distributor is thus located lower in the height direction, i.e. below the forward extending or projecting air discharge duct. In the final assembly position of the air discharge unit, it is favorably arranged in particular behind the front panel. In particular, it is detachably mounted on the rear wall thereof. Preferably, the cavity of the air distributor is closed at its lower end in an airtight and/or watertight manner so that it forms a condensate collection tank in its lower region.

In particular, the air discharge unit, which comprises the air discharge duct, the air pre-distributor and the connection for the air supply line, is designed as one part or one piece, i.e. it forms a single component. This greatly simplifies its assembling/dismantling. Preferably, it is made of plastic, in particular by plastic injection molding.

With the invention, it is further possible that, when the front panel is dismantled, the air outlet having an air distributor, which supplies it with air, in particular dishwasher interior air, and a, preferably rear, connection which is allocated in particular thereto and which in particular comprises a rear air inlet opening, remain together as a common air discharge unit and in this case an air connection line or air supply line which is designed in particular with excess length and can be designed, for example, as a flexible connection hose or corrugated connection tube issues into the connection and can still be held in a mounted position on the connection of the air discharge unit. Removal of the front panel is therefore easy and does not lead to further problems of forced dismantling of the air discharge unit that is located behind and has the air connection line coupled to its connection. The air connection line is connected with its upstream end to at least one air outlet opening in at least one boundary wall of the dishwasher cavity. Preferably, the air outlet opening is located in a side wall of the dishwasher interior. Expediently, an air conveying element such as, for example, a fan is inserted into the air connection line so as to extract dishwasher interior air from the dishwasher interior. In this way, an upstream section of the air connection line fluidically connects the air outlet opening that is provided in a boundary wall of the dishwasher interior with the air inlet of the air conveying element, while a downstream section of the air connection line fluidically connects the air outlet of the air conveying element with the, preferably rear, connection of the air discharge unit. This air conveying element draws in dishwasher interior air from the dishwasher interior via the upstream section of the air connection line and discharges it via the downstream section of the air connection line via the connection of the air discharge unit into its air pre-distributor.

If the front panel is allocated a front protective frame, which in turn is connected or can be connected to the air discharge unit, preferably to its, in particular slot-shaped, air discharge duct, the protective frame can conceal saw edges in the front panel, ensure forced alignment of the air discharge unit and always ensure the correct position of the parts against one another during installation and removal, in particular if the protective frame itself is detachably connected or can be detachably connected to the air discharge unit, in particular by bracing. Preferably, the protective frame is inserted into an upward open cutout region of the front panel—preferably from the front—and is firmly connected there to the front panel, in particular by at least one screw connection.

An advantageous retaining connection between the air discharge unit, which comprises the air outlet, and the front panel can be achieved by one or more clip or snap connections. This clip connection or snap connection is mechanically stable and yet easily detachable.

It is possible to provide on the rear side of the front panel, said rear side facing away from the front, retaining cones having spreading wings which are distributed over their circumference and can be connected to the air discharge unit. The air discharge unit can then be plugged onto these retaining cones.

It is also possible to provide at least one releasable clip or snap connection between the air discharge unit and the protective frame. In this case, the forward extending, in particular slot-shaped, air discharge duct of the air discharge unit is releasably connected to this from the rear side. For this purpose, at least one retaining tab for connection to the air discharge unit can preferably be provided on the rear side of the protective frame, said rear side facing away from the front side. This can be disengaged from the air discharge unit in particular by engaging a tool from the front side of the protective frame. If the retaining tab is provided with latching elements, as the front panel is pressed in said retaining tab can automatically latch with the air discharge unit of the air outlet and retain it securely.

In addition or as an alternative to the clip connection, the retaining connection between the air discharge unit, which comprises the air outlet, and the front panel can comprise a magnetic connection, for example via neodymium magnets.

It is also possible, additionally or alternatively, for the retaining connection between the air discharge unit, which comprises the air outlet, and the front panel to comprise a Velcro® connection.

Very advantageously, the air outlet forms an air discharge duct several centimeters long in the direction toward the front side and the discharge direction of said air discharge duct is inclined downward by several degrees relative to the external floor, such as, for example, the kitchen floor. This allows the moist outflowing air to pass under a door leaf that projects relatively far downward, and to only rise further forward in the outer space due to its own heat compared to the surrounding colder kitchen air. The door leaf as well as surrounding furniture fronts are thus well protected against moisture.

In particular, the air discharge duct is inclined between 2° and 10°, preferably between 4° and 6°, toward the external floor such as, for example, kitchen floor, so as to allow the desired underflow of a furniture leaf that is attached to the front of the front door, but on the other hand does not flow down so far, i.e. flow downward, that moisture forms on the external floor such as, for example, kitchen floor. A somewhat greater inclination up to a maximum of approx. 20° is also possible.

If the air outlet (particularly in relation to a household dishwasher with a 60 cm appliance width) is at least 40 centimeters wide overall, a very wide and uniform distribution of the moisture and the air flowing out can be achieved. Particularly favorably, the width of the air outlet can occupy almost the entire width of the appliance.

In particular, the air outlet is designed as a flat slotted outlet with a height-to-width ratio of between 1:20 and 1:200, preferably of about 1:100 (especially in relation to a household dishwasher with a 60 cm appliance width).

Despite the structurally and visually very low height, a high discharge surface can thus be achieved.

A high efficiency can be achieved if the air outlet can be controlled by at least one conveying element such as, for example, a fan wheel, which is arranged in the lower region of the household dishwasher in the depth direction behind the air discharge unit that comprises the air outlet. The fan wheel or the like can then be located at approximately the same height as the air outlet itself and can be arranged in the plinth of the household dishwasher to save space.

A favorable further development of the invention provides that the fan wheel or a similar conveying element is controllable in cycles or also continuously, namely during the drying phase of the respective dishwashing program and/or also beyond the end of this drying phase over a period of several days. In the latter case, the household dishwasher can serve in a favorable manner as storage furniture or storage for items to be washed, such as, for example, dishware, glasses, cutlery and the like, and these items to be washed that have been previously washed and dried during the respective dishwashing program that is executed can also be dried repeatedly in phases or also continuously over a period of several days. The front door of the household dishwasher preferably remains closed both during the regular drying phase of the respective dishwashing program that is to be implemented and during any subsequent "storage function phase". This storage of items to be washed in the dishwasher interior of the dishwasher cavity, preferably with the front door remaining closed, following the end of the drying phase of the respective previously executed dishwashing program, is referred to as the "storage function phase". The conveying element can be controlled both for its operation during the drying phase of the respective dishwashing program and during any subsequent "storage function phase", if necessary via moisture detection in the dishwasher interior of the dishwasher cavity.

Further advantages and features result from exemplary embodiments of the subject matter of the invention shown in the drawing and described below.

DETAILED DESCRIPTION OF EXEMPLARY EMBODIMENTS OF THE PRESENT INVENTION

Figure 1:
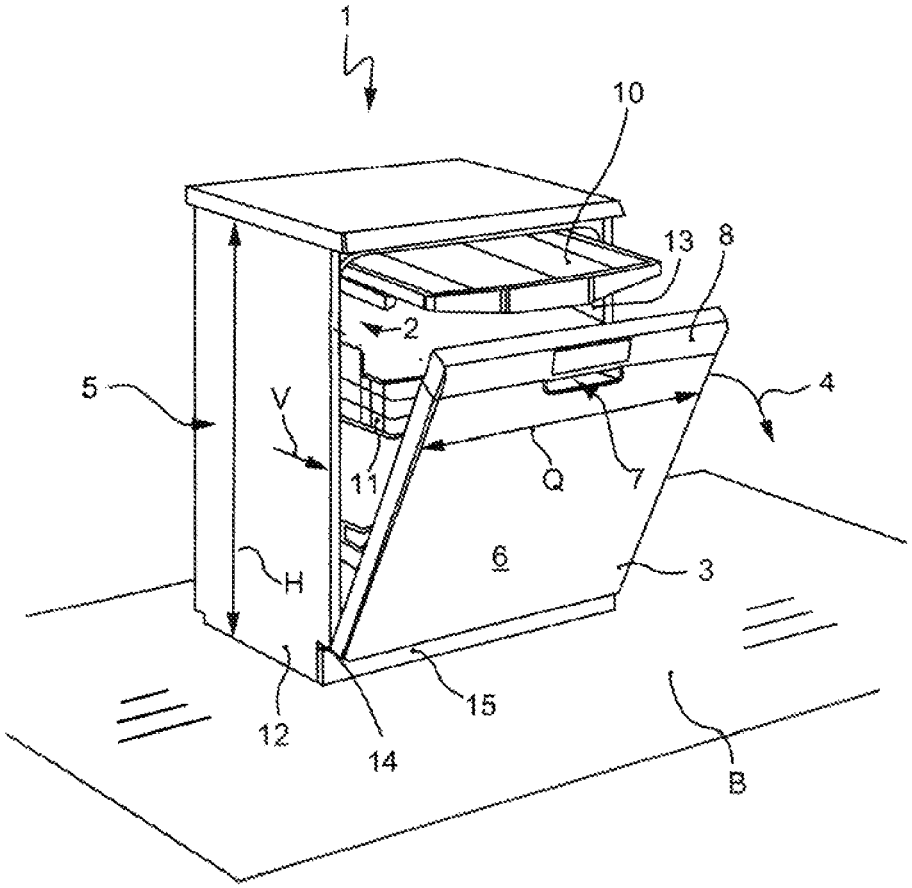
FIG. 1 shows a schematic perspective view obliquely from the front of an embodiment of a household dishwasher having a setback plinth in the lower region.

The household appliance shown schematically in FIG. 1 is here a household dishwasher 1. Other household appliances 1 having a drying function for the items to be processed can also be considered in principle for a design in accordance with the invention.

The household dishwasher 1 that is described below according to FIG. 1 has, as part of an appliance body 5 that is partially open or closed to the outside, a dishwasher cavity 2 for receiving items to be washed, such as, for example, dishware, pots, cutlery, glasses, cooking utensils and the like, which are to be processed. The items to be washed can be held, for example, in dishware baskets 11 and/or a cutlery drawer 10 and can be acted upon by so-called washing liquor. In this context, washing liquor is understood to be fresh water or, in particular, water that is circulating during operation with or without detergent and/or a rinsing agent and/or drying agent. In particular, the washing liquor or washing liquid has passed through an ion exchanger for softening. In addition, the washing liquor can also have more or fewer contaminants added to it from the ongoing operation. The dishwasher cavity 2 can have an at least substantially rectangular outline with a front side V that faces a user in the operating position. This front side V can form part of a kitchen front that consists of juxtaposed kitchen furniture or, in the case of a stand-alone appliance, can also be without reference to further furniture.

The dishwasher cavity 2 can be closed, in particular at this front side V, by a front door or flap 3. This front door 3 is shown in FIG. 1 in a partially open position and then at an angle to the vertical. In its closed position, on the other hand, it stands upright and, according to the drawing, in order to be opened can be pivoted open about a lower horizontal axis forward and downward in the direction of the arrow 4, so that in the fully open position it is at least almost horizontal.

On the outer and front side V of the household dishwasher 1, which is vertical in the closed position and faces the user, the front door 3 can be provided with a decorative panel 6 to provide a visual and/or tactile enhancement and/or to match surrounding kitchen furniture.

The household dishwasher is designed here as a stand-alone or as a so-called partially integrated or also as a fully integrated appliance. In the latter case, the appliance body 5 can also be essentially flush with the outer walls of the dishwasher cavity 2. It is then possible to forego a housing that surrounds this on the outside. In the lower region of the household dishwasher, there is a plinth 12 on which the dishwasher cavity 2 is mounted and which serves in particular to receive functional elements of the household dishwasher, such as, for example, a pump for circulating the washing liquor, an emptying pump, a pump sump, a control unit, etc. In this plinth 12 itself or, as here in the exemplary embodiment, in its front setback space, an air outlet 14 is provided, which is described further below and which partially engages over a front panel 15, which visually closes off the plinth or the plinth setback region to the front, toward the front side V.

In the exemplary embodiment according to the drawing, the movable front door 3 is allocated in its upper region a front control panel 8 which extends in the transverse direction Q of the household dishwasher and which can comprise an engagement opening 7 that is accessible from the front side V so as to facilitate the manual opening and/or closing of the door 3. In the transverse direction Q, the household dishwasher often has an extent of 45, 50 or 60 centimeters. In the depth direction T from the front side V to the rear, the extent is also frequently about 60 centimeters. The values are not mandatory. Also, the household dishwasher 1 does not have to stand directly on a floor B such as, for example, of a kitchen room, but can also be installed approximately at eye level within a piece of kitchen furniture, so that the problem of drafts through an air outlet 14 mentioned at the beginning must then be given special attention. In a fully integrable household dishwasher, the front control panel 8 in the upper region of the front door is omitted and replaced by a control panel in the upper edge of the front door. Other arrangements of the control panel on and/or in the front door are also possible. If necessary, the control panel can be omitted altogether, for example if the operation of the household dishwasher can be controlled and/or monitored using a mobile communication device such as, for example, a smartphone.

When the door or flap 3 is in the closed position, the dishwasher cavity 2 is defined circumferentially by a total of three fixed vertical walls 13 and two horizontal walls 13, one of which forms a top (top) and another a bottom (bottom) of the dishwasher cavity 2. A left upright side wall 13 and a right upright side wall 13 adjoin the front side V, which faces the user, in the transverse direction Q toward the left and toward the right, respectively.

The wall that forms the bottom of the dishwasher cavity 2 and delimits it substantially downward lies approximately horizontally above the plinth 12, in other words parallel to an external floor B, in particular of a kitchen room, on which the household dishwasher 1 can stand. A higher installation, for example approximately at the height of a worktop, is also possible as mentioned, in particular within a cabinet unit. The lower edge of the household dishwasher 1 is then approximately 70 to 110 centimeters above the floor B in the installation position.

The household dishwasher 1 is provided with at least one air outlet 14 so as to discharge, in particular, moist air from the dishwasher interior of the dishwasher cavity 2. This air outlet 14 can discharge air, in particular moist air, from the dishwasher interior of the dishwasher cavity into the free air space on the front side V of the household dishwasher 1, said front side facing a user, so that the moist air is not carried inside a kitchen unit and could not cause damage there due to moisture. The, in particular, moist dishwasher interior air is discharged by means of the air outlet 14 preferably during the program-ending drying phase of a dishwashing program that is to be executed and/or during at least one additional drying phase of a subsequent "storage function phase". In any case, the front door 3 remains closed.

Figure 2:
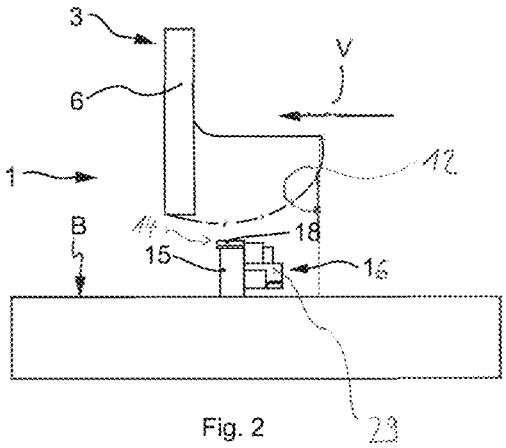
FIG. 2 shows a side view of the lower region of the household dishwasher of FIG. 1, which shows its front door with a decorative panel that is attached to the front and projects downward and behind which a plinth setback space of the household dishwasher is provided between its forward-projecting dishwasher cavity and its plinth or base assembly that is setback in the depth direction relative to the front door and wherein in this case, by way of example, a front panel is positioned standing on the floor (as a foot plinth strip) at a depth distance from the front side of the plinth, said front panel being used as a carrier for an air discharge unit that comprises an air outlet.
Figure 4:
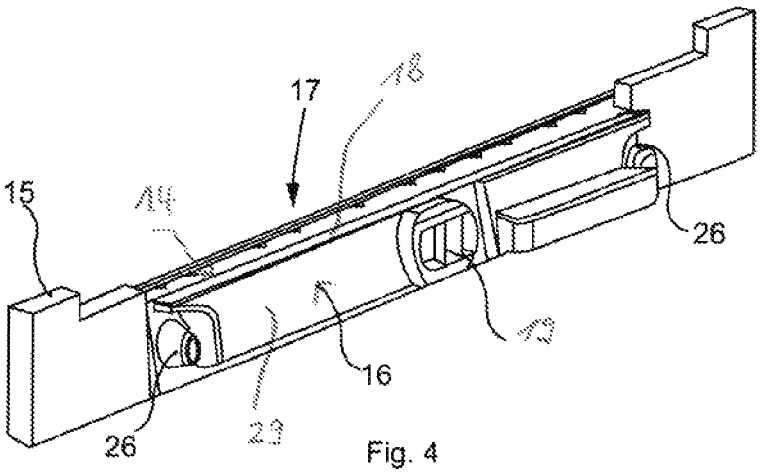
FIG. 4 shows a version of such a front panel in a perspective oblique view from the rear, which is provided on the rear side with retaining cones for clipping the air discharge unit onto the rear side of the front panel.
Figure 8:
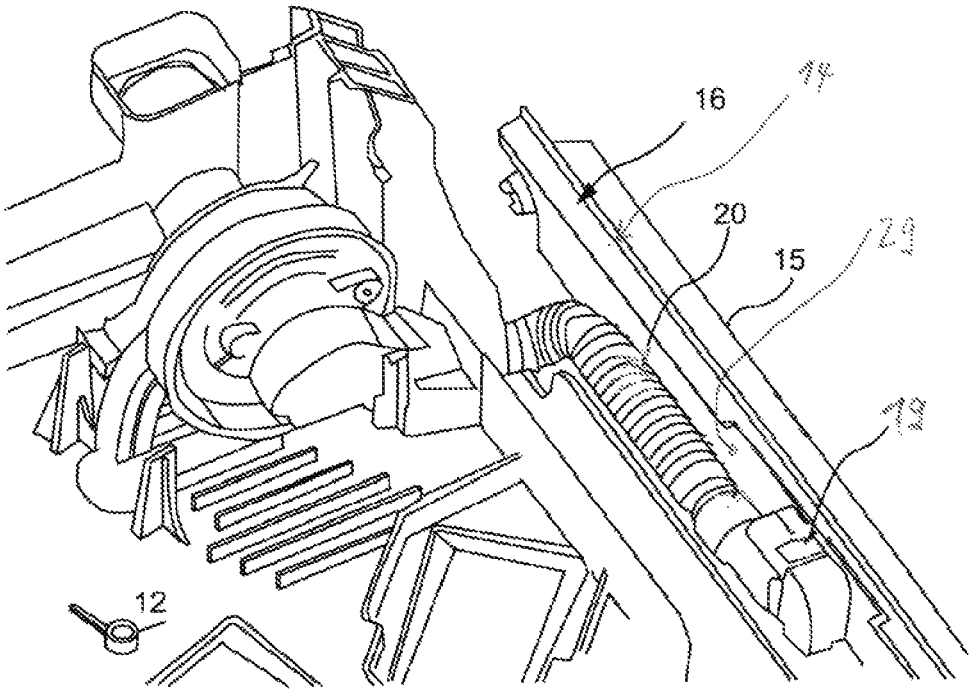
FIG. 8 shows a view of the rear side of the front panel of FIGS. 1-7 as seen obliquely from above and to the front, with the air discharge unit attached thereto, wherein an associated air supply line—here in the exemplary embodiment in the form of a corrugated hose, which is installed lying in the transverse direction—is connected to the connection of the air discharge unit, which is preferably on the rear side in the exemplary embodiment.

The air outlet 14 is part of an air discharge unit 16, which is shown by way of example in FIGS. 2, 4, 8. In this case, the at least one air outlet 14 extends over two thirds, in particular also more, of the width Q of the household dishwasher 1. In this way, a particularly uniform distribution of the air flowing out can be achieved, so that the draught phenomenon is minimized.

The air discharge unit 16 can be made entirely of plastic. Furthermore, the air outlet 14 can be divided into multiple mutually aligned sub-slots. These do not all have to be of the same length. It is important that a broadly extended air outlet 14 is created overall, which allows a high air throughput in order thus to also achieve a broad distribution of the moisture that is contained in the air.

The air outlet 14 is arranged here in the lower quarter of the appliance height and extends—as described—as a single-part or multi-part slotted outlet over at least two thirds of the width Q of the household dishwasher 1. In particular, the air outlet 14 is at least 40 centimeters wide (in particular in the case of a household dishwasher with an appliance width of 60 cm). It can also extend over almost the entire width Q of the household dishwasher 1.

Figure 3:
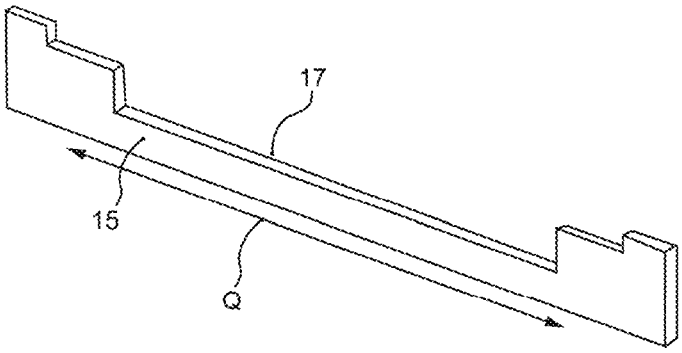
FIG. 3 shows a perspective view obliquely from above of the front panel of FIG. 2 which is cutout in the central region relative to the transverse direction and which is set back in the plinth setback region of the plinth that is setback in the depth direction of the household dishwasher of FIGS. 1, 2 relative to the front door, which is fitted with the decorative panel, and is arranged in front of the front of the plinth.

As can be seen in FIG. 3, for example, the front panel 15 that covers the plinth 12 at the front has in its upper region a cutout 17 of a corresponding width so as to accommodate an air discharge duct 18 of the air outlet 14 in such a way that, in the mounted position of the air outlet 14, it engages over the upper edge of the front panel 15 toward the front side V and can discharge to the front. In particular, the outlet duct 18 projects at least far enough to reach the front upper edge of the front panel 15. The air outlet 14 therefore engages with the air discharge duct 18 over the front panel 15 that closes the plinth 12 at the front or projects at least the same distance toward the front side V with respect thereto. In the side view, the air discharge unit 16 thus has an approximately upside-down L-shape, wherein the air discharge duct 18 forms the short leg of an L, which lies approximately horizontally and points in the direction of the front side V.

The air discharge unit 16 that comprises the air outlet 14 is held overall indirectly or directly on the front panel 15, which is attached to the front side V and visually closes off the front plinth setback region of the household dishwasher to the front. In the exemplary embodiment of FIG. 2, the plinth panel 15 is offset in the plinth setback space relative to the decorative panel 6 of the front door 3, said decorative panel projecting downward in the direction of the floor B, as viewed in the depth direction, and is positioned with a free space in the depth direction in front of the front side of the plinth 12. It stands with its underside on the floor B. The air discharge duct 18 that engages over the upper edge of the front panel 15, in particular resting on its upper edge, lies with a free space below the lower edge of the decorative panel 6, as viewed in the height direction, so that its lower edge can pivot back unimpeded and freely into the setback space along a movement circle section. This is indicated by a dashed dot curve in FIG. 2. In addition, this free space allows the air stream that is discharged out of the air outlet opening to flow forward far enough away from the lower edge of the decorative panel 6 horizontally or at an angle of a few degrees downward freely forward into the free space in front of the front door that is fitted with the decorative panel at the front.

In this exemplary embodiment, the air discharge unit 16 preferably has an air pre-distributor 29 which, in its final assembly position, projects upward and extends in the width direction Q and the air discharge duct 18 of the, in particular slot-shaped, air outlet 14 that projects toward the front side is connected at the upper end of said air pre-distributor, and which has a connection 19, in particular at the rear (see FIG. 8), for an air supply line 20. In the final assembly position of the air discharge unit 16, the air distributor 29 is thus located lower as viewed in the height direction, i.e. below the forward extending or projecting air discharge duct 18. In the final assembly position of the air discharge unit 16, it is favorably arranged in particular behind the front panel 15. In particular, it is detachably mounted or held on the rear wall thereof. Preferably, the cavity of the air distributor 29 is closed at its lower end in an airtight and/or watertight manner, so that it forms a condensate collecting tank in its lower region.

In particular, the air discharge unit 16, which comprises the air discharge duct 18, the air pre-distributor 29 and the connection 19 for the air supply line 20, is designed as one part or one piece, i.e. it forms a single component. This greatly simplifies its assembling/dismantling. Preferably, it is made of plastic, in particular by plastic injection molding.

The retaining connection between the air discharge unit 16, which comprises the air outlet 14, and the front panel 15 can be released when the front panel 15 is removed. Thus, even when the front panel 15 is opened, for example for maintenance purposes, for which the front panel 15 in particular is tilted forward and pulled out of the plinth setback space to the front, the air discharge unit 16 as a whole can be held together and does not have to be disassembled. This greatly facilitates handling when access to the plinth 12 is required and eliminates the possibility of errors, such as, for example, as a result of incorrect re-mounting.

For special simplification, the retaining connection between the air discharge unit 16, which comprises the air outlet 14, and the front panel 15 can be detached without the use of tools when the front panel 15 is dismantled, which makes the work particularly easy for the respective installer.

In the simplest case, which will be discussed in more detail below, the retaining connection between the air discharge unit 16, which comprises the air outlet 14, and the front panel 15 can be released simply by dismantling the front panel 15. It is then sufficient to pull away and/or rotate away the front panel 15 with a component toward the front side V, then the retaining connection to the air discharge unit 16 is also automatically released without a further work step.

Depending on the design, it is also possible to bring the retaining connection between the air discharge unit 16, which comprises the air outlet 14, and the front panel 15 into an engaged position by assembling the front panel 15 without the use of tools. Then it is sufficient for the connection to the air discharge unit 16 if the front panel is pushed or rotated back into its initial position on the appliance body. This is, of course, the simplest solution for an installer.

When the front panel 15 is dismantled—for example, for repair or maintenance purposes—the air outlet 14 having the air distribution 29 that supplies it and a rear connection 19 remain together as a common air discharge unit 16, regardless of the type of releasable retaining connection, and also a line (air supply line) 20 that supplies air and issues into the connection 19 and is designed in particular with excess length—in this exemplary embodiment (see FIG. 8) preferably a corrugated tube, which in the assembled position lies in the transverse direction Q, or a flexible air hose, in particular a corrugated hose, which is lying in the transverse direction Q in the mounted position—can be held in a mounted position on the air discharge unit 16. The air discharge unit 16 and the air supply line 20 thus remain together as a common unit when the front panel is dismantled and also thereafter. The air supply line 20, which is preferably designed with excess length and which issues into the connection 19 and is fastened therein, remains held in this mounted position, since the entire air outlet assembly 16 can be detached from the front panel 15 before excessive tensile stress is applied to the connection site between the air supply line 20 and the connection 19, which could lead to the air supply line 20 becoming detached from the connection 19, and/or before excessive tensile stress is applied to the air supply line 20, which could lead to overstressing or damage thereof.

Figure 5:
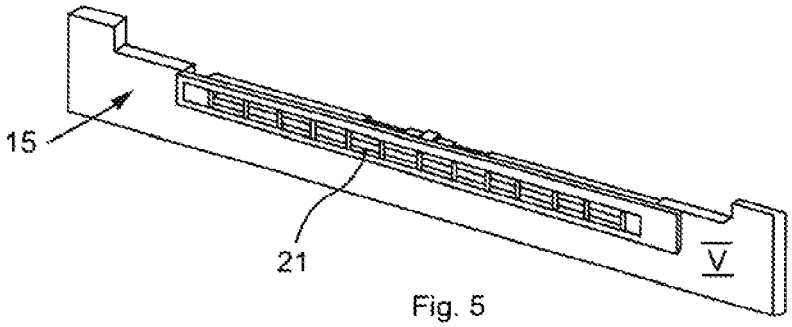
FIG. 5 shows the front panel in the version shown in FIG. 4, in a view obliquely from the front, wherein a protective frame that is inserted into said front panel is also visible and the forward extending, slot-shaped air discharge duct of the air outlet unit is connected, preferably in a detachable manner, to the rear of said protective frame.
Figure 7:
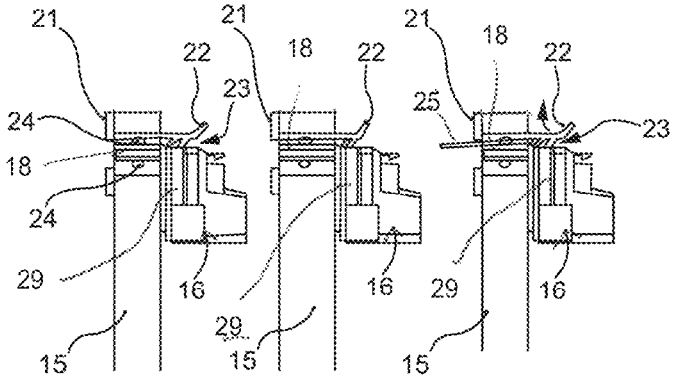
FIG. 7 shows a cross-sectional view of the front panel of FIGS. 1-4 with a retaining tab at the rear, wherein in the right partial figure the retaining tab is disengaged by engaging a tool from the front.

As can be seen, for example, in FIG. 5, in one version the front panel 15 can be allocated a front protective frame 21 which is designed, for example, in the manner of a ventilation grille and engages with edge-side frame parts over the edges of the cutout 17, for example saw edges, so that any tears are covered. The protective frame 21 is preferably inserted from the front side V and can therefore be braced with the air discharge unit 16 that is located behind it, in particular its forward projecting or extending air discharge duct 18, without being able to be pulled backward, into the household dishwasher 1. Therefore, in the version shown in FIG. 7, the protective frame 21 is provided with at least one rear retaining tab 22, which in turn has latching elements 23. The air discharge unit 16 can thus engage from the inside between two elastic retaining lines 24, for example rubber, with the air discharge duct 18, which is thus fixed in its position extending up to the front side V of the front panel and is securely connected to the air discharge unit 16 via the resiliently downward biased retaining tab 22.

The latching elements 23 can easily engage positively in corresponding undercuts on the air pre-distributor 29 and/or the air discharge duct 18 or act on the air discharge unit 16 only by frictional engagement. In the case of positive engagement, a clip connection which automatically engages as the front panel 15 is pushed on is created as a retaining connection between the air discharge unit 16 and the front panel 15. In order to release the latching elements 23 from the undercuts on the air pre-distributor 29 and/or air discharge duct 18, it is possible in particular to insert a tool 25 from the front of the protective frame 21, as shown in the rightmost partial figure of FIG. 7.

Figure 6:
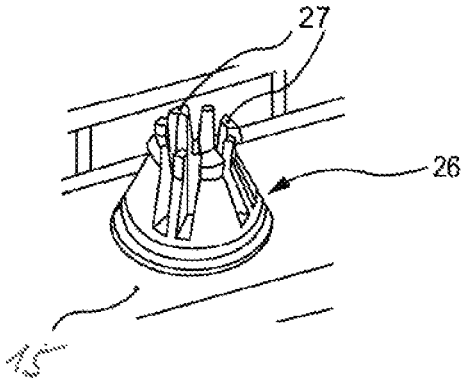
FIG. 6 shows a detailed view of a retaining cone of FIG. 5.

A clip connection between the air discharge unit 16, which comprises the air outlet 14, and the front panel 15 is also shown in FIGS. 4 to 6: There, retaining cones 26 having spreading wings 27 that are distributed over their circumference are provided on the rear side of the front panel 15, said rear side facing away from the front side V, and said spreading wings can be connected to the air discharge unit 15, in particular to its air pre-distributor 29, in a latching manner. The connection can be closed by pressing the front panel 15 backward against the front side V and opened by pulling in the direction of the front side V.

In addition or alternatively, the retaining connection between the air discharge unit 16, which comprises the air outlet 14, and the front panel 15 can also comprise a magnetic connection and/or a Velcro® connection—not illustrated here in each case.

As already mentioned above, the air outlet 14 having its air discharge duct 18 which extends broadly in the transverse direction Q but conducts the air in the direction of the front side V can engage over the front panel 15 that closes off the plinth 12 at the front and project at least the same distance toward the front side V with respect thereto. The plinth 12 can be set back by a few centimeters with its front-side facing front panel 15 relative to the door 3, nevertheless, wetting of the lower edge of the door 3 can be avoided by the forward facing component of the air discharging velocity. In addition, according to an advantageous further development, an upper guide, for example an upper wall, of the air outlet 14 at its air discharge duct 18 can be arranged in particular at a slight angle such that the air flowing out is discharged a few degrees downward into the room. Thus, the air does not flow out in a completely horizontal manner, but can be conveyed through the downward component under the door 3 without causing moisture damage there. The wide extent of the air outlet 14 prevents an annoying draft. With the downward component, the discharged air is carried a few centimeters in front of the appliance 1, and in particular by a direct path, i.e. unimpeded or without deflections, before an upward component becomes effective due to the fact that the discharged air is generally warmer than the surrounding room air. The downward component is between 2° and 10°, and a discharge angle of between 4° and 6° relative to the horizontal is particularly favorable in order to protect the door from moistening and at the same time to also prevent moisture from reaching the external floor B, such as, for example, a kitchen floor.

For this purpose, in particular, the air outlet 14 having its air discharge duct 18 is designed as a flat slotted outlet whose height-to-width ratio can preferably be between 1:20 and 1:200, preferably approximately equal to 1:100 (in particular in relation to a household dishwasher with a 60 cm appliance width). Then, in the case of a 40-centimeter-wide air outlet 14 (in particular in relation to a household dishwasher with a 60-cm appliance width), its height in the height direction H is in particular less than about 8 mm, preferably about equal to 4 mm. This ensures that on the one hand the air outlet 14 takes up little installation space in the height direction H, and on the other hand the total extent of the air outlet 14 is large enough to discharge a high volume and thus keep drafts very low.

It is possible so as to supply air to allocate at least one conveying element in or upstream of the connection to the air outlet 14 of the line 20 and said conveying element can also be activated in cycles, even over a period of several days.

Such a household dishwasher 1 can also easily be provided with a so-called "storage function", which allows the items to be washed to remain in the dishwasher cavity 2 after processing without becoming damp again. Such processed items to be washed can remain in said household dishwasher for several days without the dryness of said items deteriorating. The household dishwasher 1 then also serves as a storage and drying cabinet from which the items to be washed can be removed fresh and dry.

For this purpose, the conveying element in particular can be activated in cycles. Alternatively, and particularly effectively, the conveying element is controlled in a closed-loop manner by a moisture sensor system that provides a measure of the current moisture of the items to be washed that are located in the dishwasher cavity.

In both cases, the conveying element is preferably switched on only now and then in order to repeatedly convey moist air out of the dishwasher cavity 2 and thus maintain the quality of the cleaning of the items to be washed over a longer period of time. Due to the only short effective running times, the energy requirement is low—as is the noise pollution caused by the at least one fan wheel or similar conveying element.

If necessary, however, it can also be advantageous if the conveying element is operated continuously with air that is to be discharged, in particular dishwasher interior air, during the drying phase of the respective dishwashing program and/or during the total duration of any subsequent "storage function phase" and/or any other operating phase of the household dishwasher.

The invention claimed is:

1. A household dishwasher, comprising:

a dishwasher cavity for processing items to be washed;

a front panel attached to a front side of the household dishwasher; and an air discharge unit arranged in a lower quarter of a height of the household dishwasher and comprising an air outlet designed to discharge air from the dishwasher cavity and arranged in the lower quarter of the height of the household dishwasher, said air outlet extending as a slotted outlet over at least two thirds of a width of the household dishwasher and configured to discharge air from the dishwasher cavity in a direction that is forward and downward from the front panel, wherein the slotted outlet is configured to engage with the front panel, said air discharge unit designed to be detachably coupled to the front panel via a retaining connection such that the air discharge unit is detachable from the front panel when the front panel is dismantled, and said air discharge unit comprising an air pre-distributor having an upper end adjoined to a duct of the air outlet, said air pre-distributor projecting upward, extending in a width direction, and being arranged at least partially behind the front panel in an assembly position of the air discharge unit.

2. The household dishwasher of claim 1, wherein the retaining connection between the air discharge unit and the front panel is detachable without using a tool when the front panel is dismantled.

3. The household dishwasher of claim 1, wherein the retaining connection between the air discharge unit and the front panel is releasable by dismantling the front panel.

4. The household dishwasher of claim 1, wherein the retaining connection between the air discharge unit and the front panel assumes an engagement position without using a tool by assembling the front panel.

5. The household dishwasher of claim 1, wherein the duct of the air outlet extends toward the front side.

6. The household dishwasher of claim 1, further comprising a plinth which is closed off by the front panel at the front side.

7. The household dishwasher of claim 5, wherein the duct of the air outlet projects at least to a same extent toward the front side with respect to the front panel.

8. The household dishwasher of claim 1, further comprising an air supply line for attachment to a connection of the air discharge unit.

9. The household dishwasher of claim 8, wherein the connection of the air discharge unit is located at a rear side of the air discharge unit.

10. The household dishwasher of claim 1, wherein the air pre-distributor of the air discharge unit is arranged in the assembly position thereof behind the front panel.

11. The household dishwasher of claim 8, wherein the air pre-distributor supplies air to the air outlet, said air outlet remaining together with the air pre-distributor and the connection to commonly form the air discharge unit, when the front panel is dismantled, with the air supply line designed in particular with excess length and mountable on the air discharge unit.

12. The household dishwasher of claim 8, wherein the air supply line is a flexible connection hose or a corrugated tube.

13. The household dishwasher of claim 1, further comprising a front protective frame connected to the front panel and connectable to the air discharge unit, in particular to the air outlet.

14. The household dishwasher of claim 13, wherein the front protective frame is detachably connected to the air discharge unit by bracing.

15. The household dishwasher of claim 1, wherein the retaining connection between the air discharge unit and the front panel comprises a clip connection.

16. The household dishwasher of claim 15, wherein the clip connection comprises a retaining cone having spreading wings that are distributed over a circumference of the retaining cone on a rear side of the front panel, which rear side faces away from the front side, said spreading wings connectable to the air discharge unit, in particular to the air pre-distributor of the air discharge unit.

17. The household dishwasher of claim 13, further comprising a retaining tab for connection to the air discharge unit on a rear side of the front protective frame, which rear side faces away from the front side.

18. The household dishwasher of claim 17, wherein the retaining tab is disengageable from the air discharge unit by engaging a tool from the front side.

19. The household dishwasher of claim 1, wherein the retaining connection between the air discharge unit and the front panel comprises a magnetic connection.

20. The household dishwasher of claim 1, wherein the duct of the air outlet has a length of several centimeters and defines a discharge direction which is inclined downward by several degrees relative to a floor.

21. The household dishwasher of claim 20, wherein that the duct of the air outlet is inclined between 2° and 10° toward the floor.

22. The household dishwasher of claim 1, wherein the air outlet is at least 40 centimeters wide overall when the household dishwasher has a width of 60 cm.

23. The household dishwasher of claim 1, wherein the air outlet is designed as a flat slotted outlet with a height-to-width ratio of between 1:20 and 1:200.

* * * * *